US008704613B2

(12) United States Patent
Hsu et al.

(10) Patent No.: US 8,704,613 B2
(45) Date of Patent: Apr. 22, 2014

(54) CAVITY FILTER HAVING FEEDBACK ARRANGEMENT

(75) Inventors: Wei-Hong Hsu, Keelung (TW); Chien-Chih Lee, Keelung (TW); Jhih-Wei Wang, Keelung (TW); Wei-Chin Hsu, Keelung (TW)

(73) Assignee: Universal Microwave Technology, Inc., Keelung (TW)

( * ) Notice: Subject to any disclaimer, the term of this patent is extended or adjusted under 35 U.S.C. 154(b) by 348 days.

(21) Appl. No.: 13/115,643

(22) Filed: May 25, 2011

(65) Prior Publication Data

US 2012/0299667 A1 Nov. 29, 2012

(51) Int. Cl.

| | |
|---|---|
| ***H01P 1/213*** | (2006.01) |
| ***H01P 1/208*** | (2006.01) |
| ***H01P 7/06*** | (2006.01) |

(52) U.S. Cl.

CPC ..... *H01P 1/213* (2013.01); *H01P 1/208* (2013.01); *H01P 7/06* (2013.01); *H01P 1/2138* (2013.01)

USPC ..... 333/134; 333/202; 333/227

(58) Field of Classification Search

CPC ..... H01P 1/213; H01P 1/208; H01P 7/06; H01P 1/2138

USPC ..... 333/202–212, 227, 235, 134

See application file for complete search history.

(56) References Cited

U.S. PATENT DOCUMENTS

2009/0058563 A1* 3/2009 Seo et al. ..... 333/209

* cited by examiner

*Primary Examiner* — Benny Lee
*Assistant Examiner* — Rakesh Patel
(74) *Attorney, Agent, or Firm* — Muncy, Geissler, Olds & Lowe, P.C.

(57) ABSTRACT

A cavity filter having two series of resonance chambers bilaterally connected between an antenna port and two opposing signal input/output ports, each series of resonance chambers having the last resonance chamber thereof connected to the antenna port and the first resonance chamber thereof connected between the respective signal input/output port and the associating last resonance chamber to perform cross-coupling feedback, improving the quality of the signal received by the signal receiver using the cavity filter and enhancing signal transmission performance.

5 Claims, 6 Drawing Sheets

CAVITY FILTER HAVING FEEDBACK ARRANGEMENT

BACKGROUND OF THE INVENTION

1. Field of the Invention

The present invention relates to electronic signal filter technology and more particularly, to a cavity filter, which has two series of resonance chambers bilaterally connected between an antenna port and two opposing signal input/output ports to perform cross-coupling feedback, improving the quality of the signal received by the signal receiver using the cavity filter and enhancing signal transmission performance.

2. Description of the Related Art

Following fast development of communication technology, many advanced wired and wireless signal transmitting and receiving equipment have been created and are widely used in different fields. However, due to limited wireless communication channels, full bandwidth utilization is quite important. For full bandwidth utilization, communication capacity and quality must be well improved. As different frequency channels may be close to one another, channel isolation must be well done to prevent interference and to maintain signal transmission quality. However, it is not easy to remove noises effectively and achieves excellent channel-to-channel isolation. A regular bandpass cavity filter (or diplexer) allows bi-directional communication of the energy at a particular frequency range over a single channel and attenuates the energy that is out of this particular frequency range. However, a cavity filter cannot completely isolate the stop-band energy, causing instability of transmission signal at the stop-band frequency. A signal feedback design may be employed to regulate the energy at the stop-band frequency. FIGS. 5 and 6 illustrate a cavity filter (diplexer) according to the prior art. According to this design, the cavity filter (diplexer) A defines a plurality of resonance chambers A01 in a resonant space A0 therein, a channel A1 in communication between each two adjacent resonance chambers A01, an antenna port A2 at the center of the resonant space A0 for transmitting/receiving signals, and two signal input/output ports A3 at two distal ends of the resonant space A0 for signal transmission. Signals received (or transmitted) by the antenna port A2 are filtered through the resonance chambers A01 and then outputted by the signal input/output ports A3. According to this design, when a signal goes through the resonance chambers A01, attenuated signal components will be diffused to interfere with the performance of the cavity filter, affecting signal receiving or transmitting stability. Therefore, it is desirable to provide a cavity filter (diplexer), which eliminates signal transmission interference and enhances signal receiving/transmitting stability.

SUMMARY OF THE INVENTION

The present invention has been accomplished under the circumstances in view. It is one object of the present invention to provide a cavity filter, which has resonance chambers arranged at two sides between an antenna port and two signal input/output ports to perform cross coupling feedback, improving signal quality and enhancing signal transmission stability. To achieve this and other objects of the present invention, a cavity filter comprises a base member defining therein a resonant space, an antenna port at the center of the resonant space, two signal input/output ports respectively disposed at two distal ends of the resonant space for signal input/output and two series of resonance chambers respectively connected between the signal input/output ports and the antenna port, an iris set between the first resonance chamber and last resonance chamber of each series of resonance chambers and a channel cut through the iris in communication between the first resonance chamber and last resonance chamber of the associating series of resonance chambers for enabling each series of resonance chambers to perform cross coupling feedback, a cover member covering the base member, and a frequency adjustment device installed in the cover for tuning to adjust the frequency and bandwidth in the resonant space.

Further, each series of resonance chambers ranges from 1st to 7th. The seventh resonance chamber of each series of resonance chambers is connected to the antenna port. The first resonance chamber of each series of resonance chambers is connected between the respective signal input/output port and the associating seventh resonance chamber.

DETAILED DESCRIPTION OF THE PREFERRED EMBODIMENT

Figure 1:
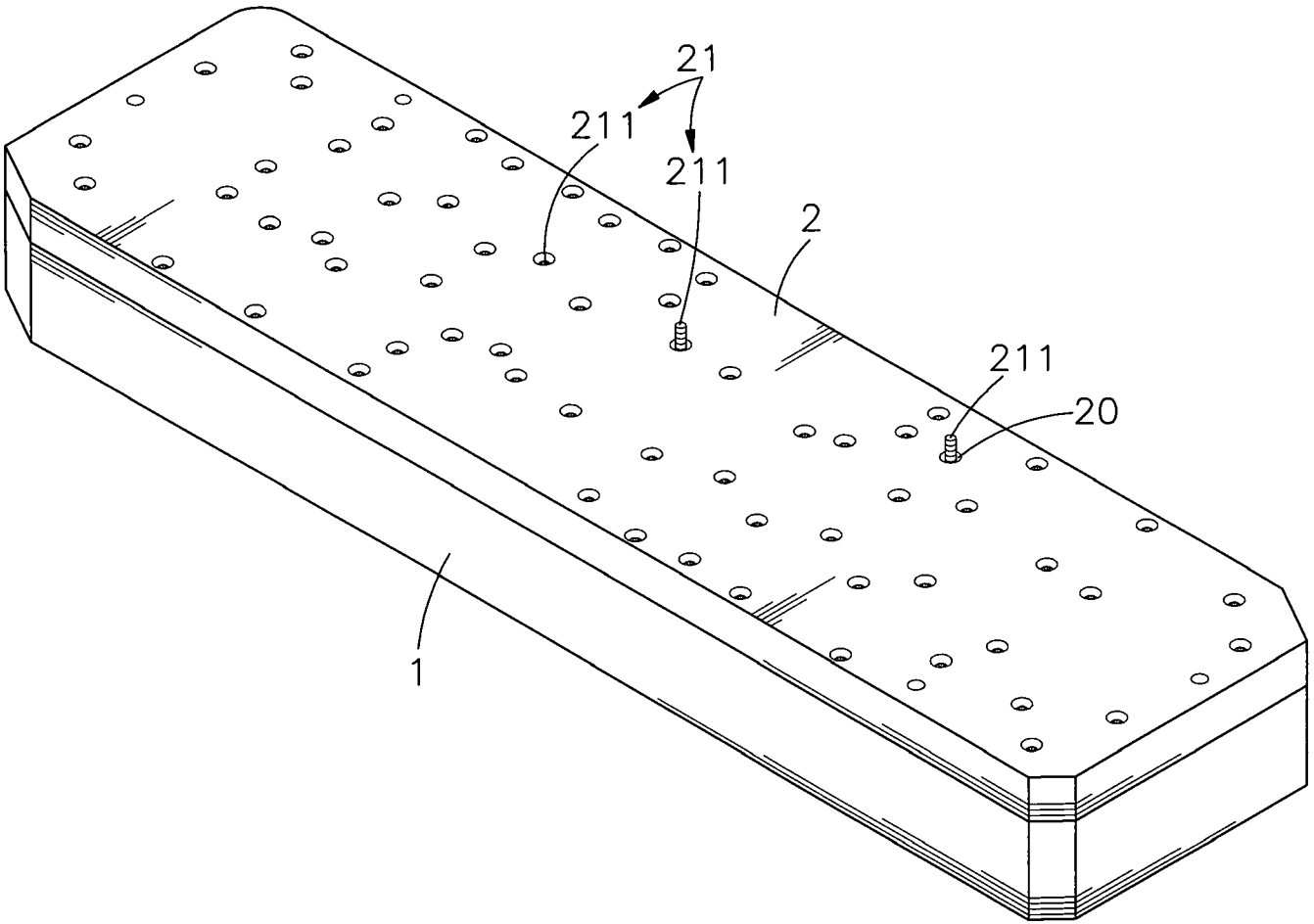
FIG. 1 is an elevation view of a cavity filter in accordance with the present invention.
Figure 2:
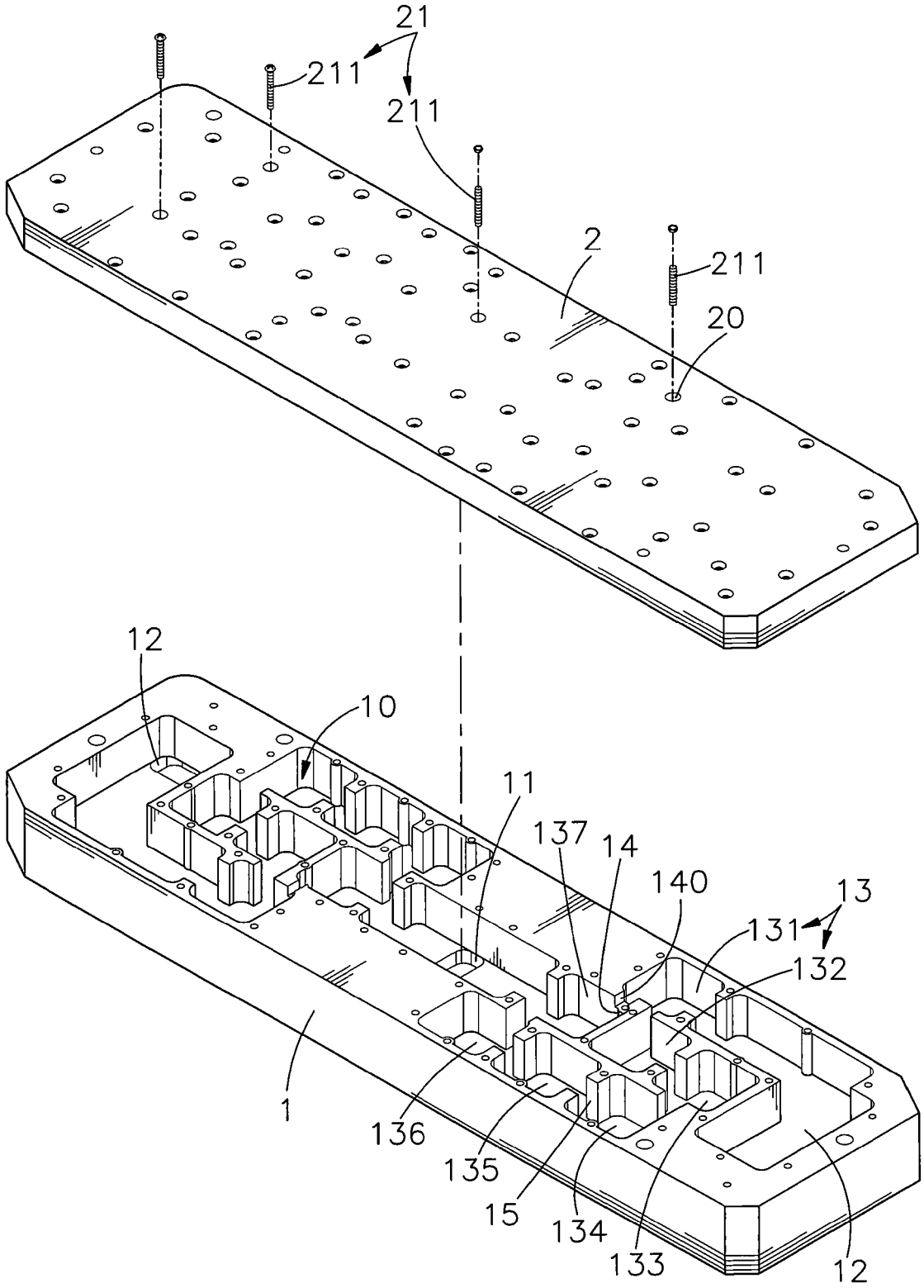
FIG. 2 is an exploded view of the cavity filter in accordance with the present invention.
Figure 3:
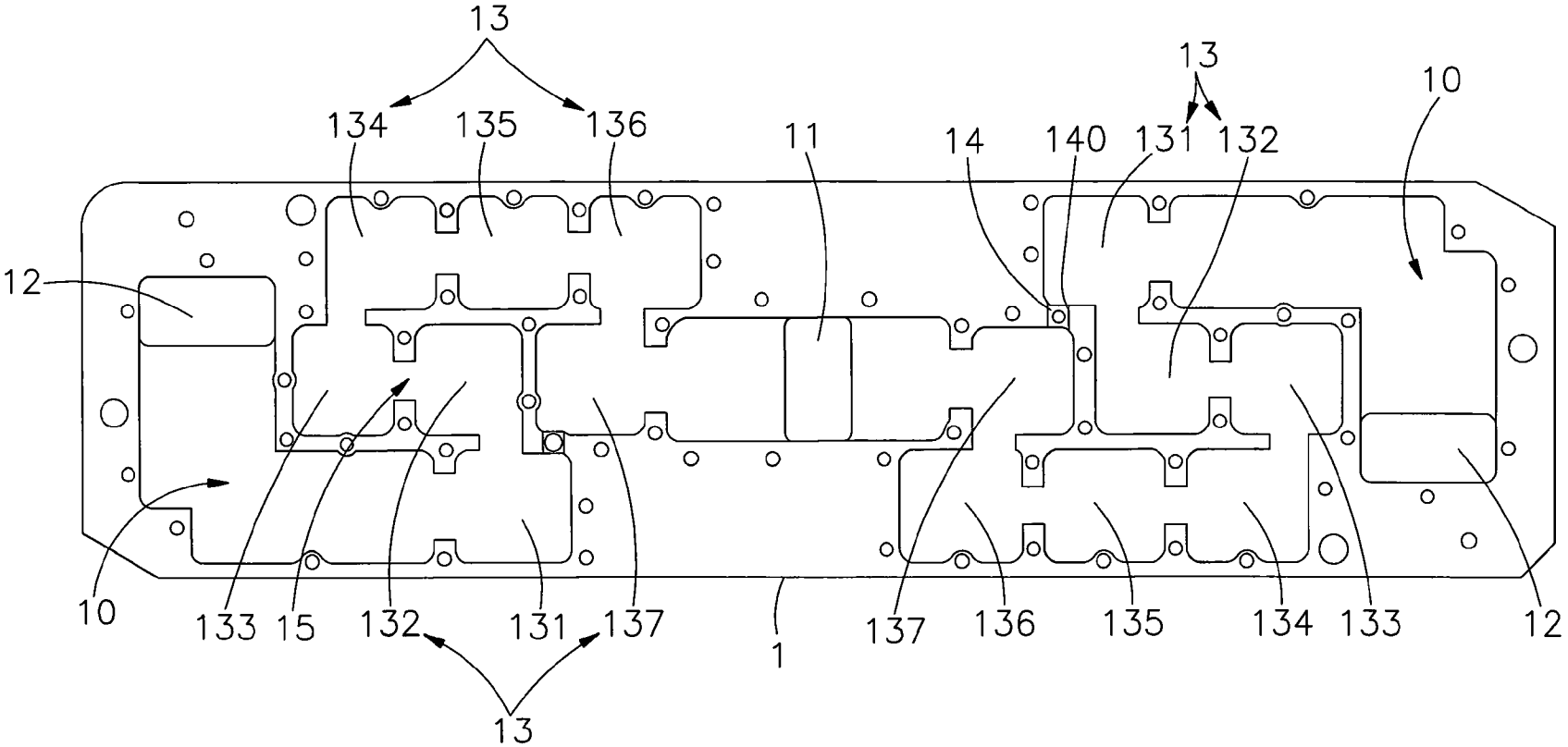
FIG. 3 is a top view of the base member of the cavity filter in accordance with the present invention.
Figure 4:
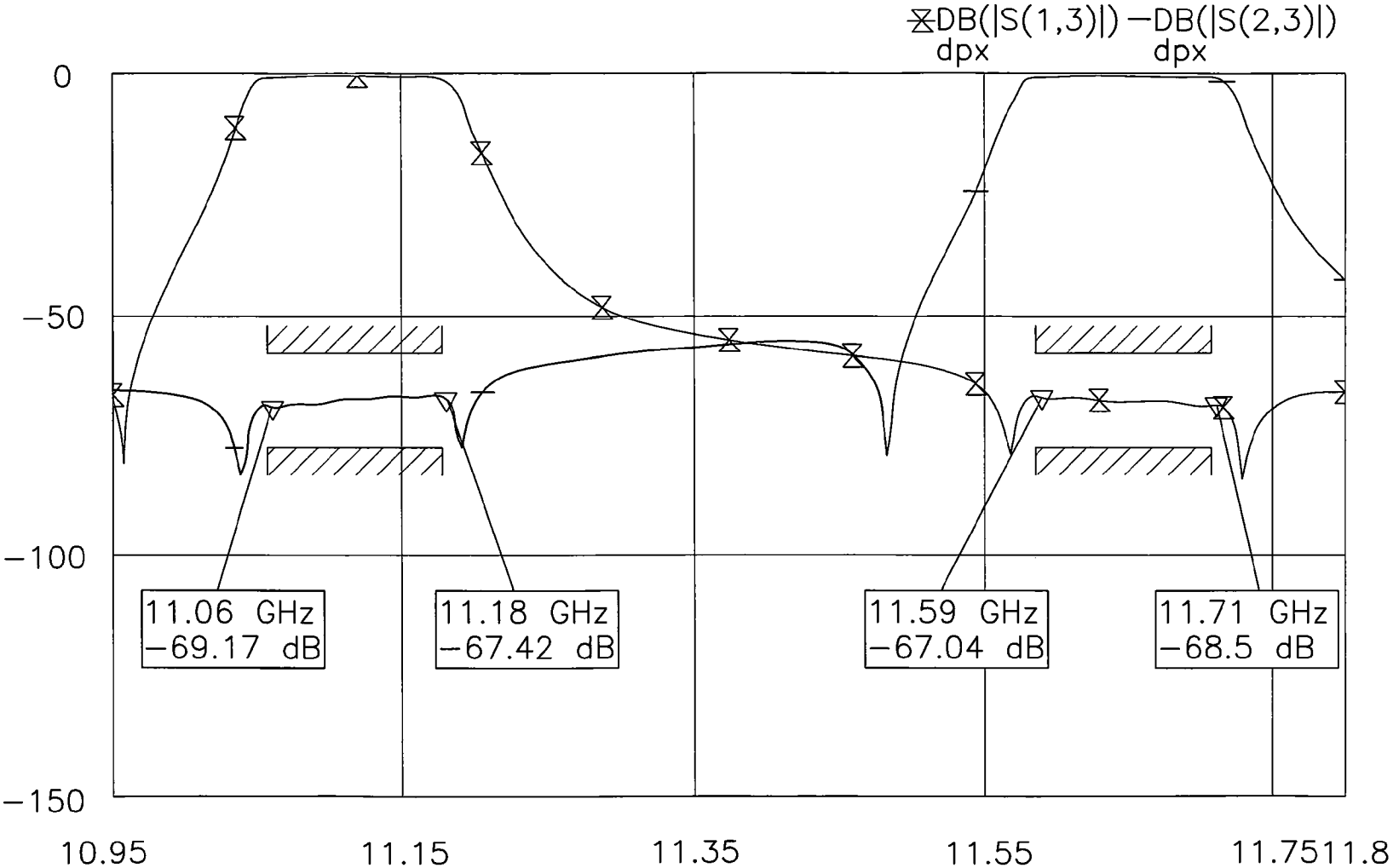
FIG. 4 is a diagram of a filtered signal obtained according to the present invention.
Figure 5:
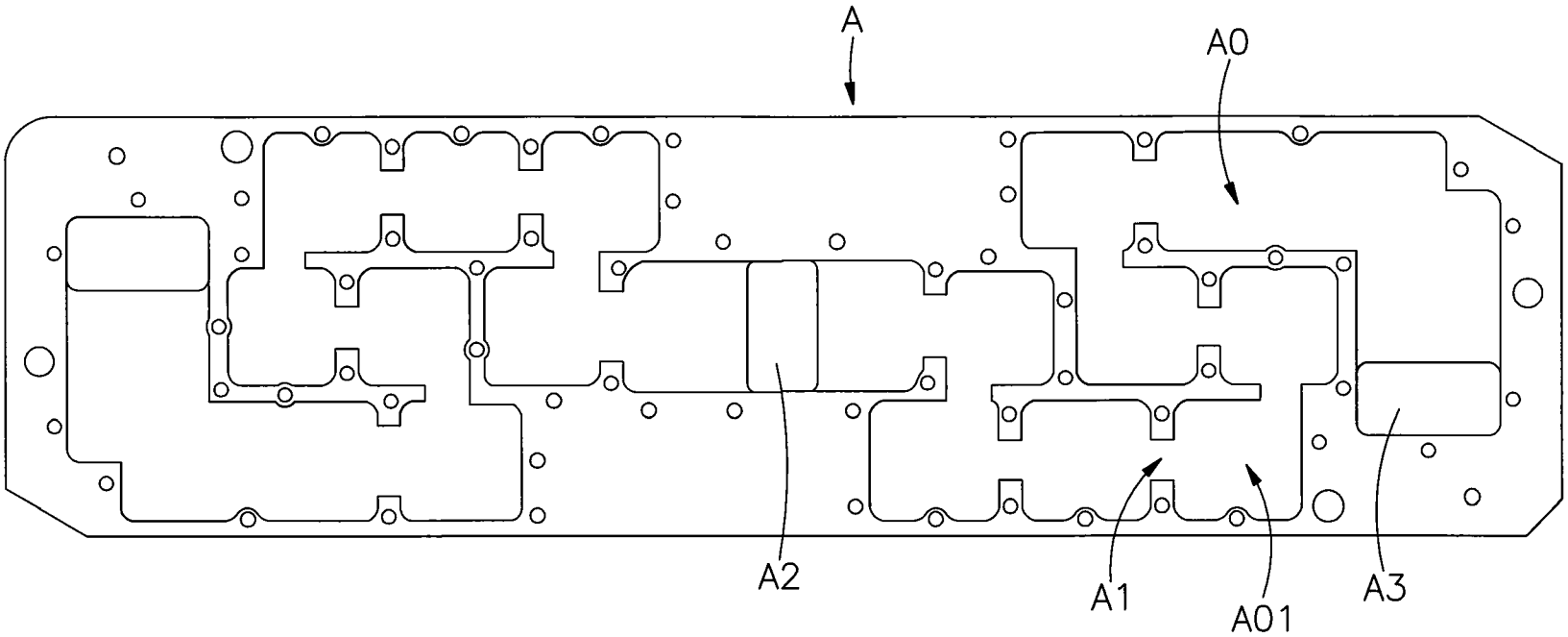
PRIOR ART FIG.5
FIG. 5 is a top view of a cavity filter according to the prior art.
Figure 6:
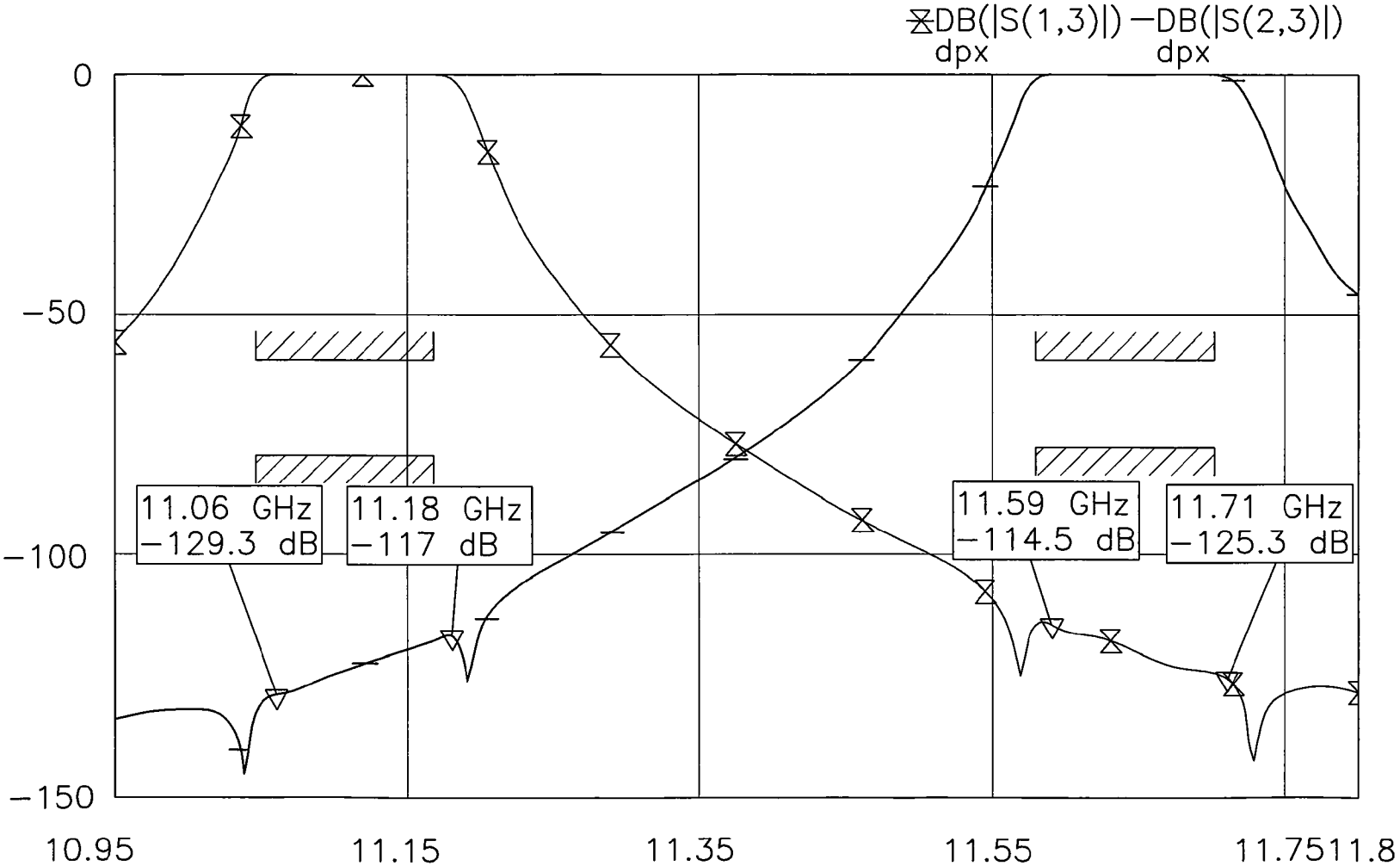
PRIOR ART FIG. 6
FIG. 6 is a diagram of a filtered signal obtained according to the prior art.

Referring to FIGS. 1 4, a cavity filter in accordance with the present invention is shown comprising a base member 1 and a cover member 2.

The base member 1 defines therein a resonant space 10, an antenna port 11 disposed at the center of the resonant space 10, two signal input/output ports 12 respectively disposed at the two distal ends of the resonant space 10 for signal input/output, two series of resonance chambers 13 respectively connected between the signal input/output ports 12 and the antenna port 11, each series of resonance chambers 13 ranging from 1st to 7th a signal guideway 15 connected between each two adjacent resonance chambers 131 137 of each of the two series of resonance chambers 13, an iris 14 set between the first resonance chamber 131 and last (seventh) resonance chamber 137 of each series of resonance chambers 13 and a channel 140 cut through each iris 14 in communication between the first resonance chamber 131 and last (seventh) resonance chamber 137 of the associating series of resonance chambers 13.

The cover member 2 is adapted for closing the base member 1, having a plurality of through holes 20 cut through opposing top and bottom sides thereof for receiving frequency-adjusting rods 211 of a frequency adjustment device 21.

During installation, the cover member 2 is covered on the base member 1, and then the frequency-adjusting rods 211 of the frequency adjustment device 21 are respectively threaded into the respective through holes 20 of the cover member 2 and tuned to adjust the frequency and bandwidth in the resonant space 10 subject to the desired frequency range and to further adjust the reverse coupling effects in the resonant space 10, enabling the series of resonance chambers 13 and the respective channels 140 to perform the cross-coupling feedback.

According to the aforesaid design, the two • series of resonance chambers 13 are respectively connected between the signal input/output ports 12 and the antenna port 11 in the resonant space 10; each series of resonance chambers 13 includes a first resonance chamber 131, a second resonance chamber 132, a third resonance chamber 133, a fourth resonance chamber 134, a fifth resonance chamber 135, a sixth resonance chamber 136 and a seventh resonance chamber 137; the first resonance chamber 131 of each series of resonance chambers 13 is kept in communication between one respective signal input/output port 12 and the associating seventh resonance chamber 137; the seventh resonance chamber 137 of each series of resonance chambers 13 is kept in communication between the antenna port 11 and the associating first resonance chamber 131. Thus, a detoured signal circulation loop is formed in the resonant space 10 inside the base member 1, enhancing resonance and harmonic.

During application, signals received (or transmitted) by the antenna port 11 are transmitted through the series of resonance chambers 13 in the resonant space 10 for fetching frequency components within a predetermined range. At this time, the frequency-adjusting rods 211 of the frequency adjustment device 21 are respectively tuned to adjust the frequency and bandwidth in the resonant space 10 subject to the desired frequency range and also to adjust the cross coupling effects in the series of resonance chambers 13. Subject to the cross-coupling feedback performance of the series of resonance chambers 13 and the respective channels 140, usable feedback frequency components are obtained from attenuated signal components to compensate for stop-band attenuation components and to improve the quality of the signal received by the signal receiver (such as wireless communication base station, satellite communication equipment or microwave transmitter/receiver antenna) that is used with the cavity filter, enhancing signal transmission stability and avoiding interference of noises.

In conclusion, the invention provides a cavity filter comprising a base member 1, which comprises a resonant space 10, an antenna port 11 disposed at the center of the resonant space 10, two signal input/output ports 12 respectively disposed at the two distal ends of the resonant space 10 for signal input/output, two series of resonance chambers 13 respectively connected between the signal input/output ports 12 and the antenna port 11, an iris 14 set between the first resonance chamber 131 and last (seventh) resonance chamber 137 of each series of resonance chambers 13 and a channel 140 cut through each iris 14 in communication between the first resonance chamber 131 and last (seventh) resonance chamber 137 of the associating series of resonance chambers 13, and a cover member 2 covering the base member 1 and carrying multiple frequency-adjusting rods 211 of a frequency adjustment device 21 for tuning to adjust the frequency and bandwidth in the resonant space 10 subject to the desired frequency range and to further adjust the reverse coupling effects in the resonant space 10 for enabling the series of resonance chambers 13 and the respective channels 140 to perform the cross-coupling feedback. Thus, the cavity filter greatly improves the quality of the signal received by the signal receiver (such as wireless communication base station, satellite communication equipment or microwave transmitter/receiver antenna) that is used with the cavity filter, enhancing signal transmission stability and avoiding interference of noises. In actual practice, the cavity filter of the present invention has the features as described hereinafter.

The base member 1 has two series of resonance chambers 13 disposed at two opposite lateral sides and respectively connected between the two opposing signal input/output ports 12 at the two distal ends of the resonant space 10 and the antenna port 11 at the center of the resonant space 10 to perform cross-coupling feedback, improving the quality of the signal received by the signal receiver using the cavity filter and enhancing signal transmission performance.

As stated above, the invention provides a cavity filter that has two series of resonance chambers disposed at two opposite lateral sides and respectively connected between two opposing signal input/output ports and a centered antenna port to perform cross-coupling feedback, improving the quality of the signal received by the signal receiver using the cavity filter and enhancing signal transmission performance.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A cavity filter comprising a base member defining therein a resonant space, an antenna port at the center of said resonant space and two signal input/output ports respectively disposed at two distal ends of said resonant space for signal input/output, a cover member covering said base member, and a frequency adjustment device installed in said cover member for tuning to adjust the frequency and bandwidth in said resonant space, wherein said base member further comprises two series of resonance chambers respectively connected between said signal input/output ports and said antenna port, an iris directly between a first resonance chamber and a last resonance chamber of each said series of resonance chambers and a respective channel cut through said corresponding iris in communication between the first resonance chamber and last resonance chamber of the associating series of resonance chambers.

2. The cavity filter as claimed in claim 1, wherein each said series of resonance chambers ranges from first to seventh resonance chambers, the first resonance chamber of each said series of resonance chambers being kept in communication with the associating seventh resonance chamber through the associating channel.

3. The cavity filter as claimed in claim 2, wherein each said series of resonance chambers has the seventh resonance chamber thereof connected to said antenna port, the first resonance chamber thereof connected between the respective signal input/output port and the associating seventh resonance chamber, and the second resonance chamber, third resonance chamber, fourth resonance chamber, fifth resonance chamber and sixth resonance chamber thereof connected in series in a proper order between the associating first resonance chamber and the associating seventh resonance chamber.

4. The cavity filter as claimed in claim 3, wherein each said series of resonance chambers comprises a signal guideway connected between each two adjacent resonance chambers.

5. The cavity filter as claimed in claim 1, wherein each resonance chamber in said two series of resonance chambers performs cross-coupling feedback via the channel cut through said iris.

* * * * *